United States Patent [19]

Tippins et al.

[11] 4,430,874

[45] Feb. 14, 1984

[54] VERTICAL COILER FURNACE AND METHOD OF ROLLING

[75] Inventors: George W. Tippins; Vladimir B. Ginzburg, both of Pittsburgh; Wayne G. Pottmeyer, Murrysville, all of Pa.

[73] Assignee: Tippins Machinery Company, Inc., Pittsburgh, Pa.

[21] Appl. No.: 307,015

[22] Filed: Sep. 29, 1981

[51] Int. Cl.[3] ..... B21B 41/02; B21B 1/26

[52] U.S. Cl. ..... 72/202; 72/229; 72/231; 72/234

[58] Field of Search ..... 72/146, 147, 148, 200, 72/202, 226, 227, 228, 229, 231, 234, 250; 242/78, 78.1, 78.3, 78.6

[56] References Cited

U.S. PATENT DOCUMENTS

| | | | |
|---|---|---|---|
| 2,658,741 | 11/1953 | Schmidt et al. | 72/200 X |
| 3,331,232 | 7/1967 | King | 72/229 X |
| 3,451,123 | 6/1969 | Fredriksson et al. | 72/227 X |
| 3,486,359 | 12/1969 | Hein | 72/200 |
| 3,803,891 | 4/1974 | Smith | 72/231 |
| 4,263,798 | 4/1981 | Wladika et al. | 72/202 |
| 4,308,739 | 1/1982 | Tippins | 72/229 |
| 4,319,474 | 3/1982 | Gronbech | 72/229 |
| 4,348,882 | 9/1982 | Tippins | 72/202 |

FOREIGN PATENT DOCUMENTS

| | | | |
|---|---|---|---|
| 1025818 | 3/1958 | Fed. Rep. of Germany | 72/228 |
| 199822 | 11/1965 | Sweden | 72/229 |

*Primary Examiner*—E. Michael Combs

*Attorney, Agent, or Firm*—Webb, Burden, Robinson & Webb

[57] ABSTRACT

A processing line for rolling metal slabs into strip thicknesses along a substantially horizontal pass line includes the utilization of an intermediate mill formed of an upstream coiler furnace and a pair of coiler furnaces downstream of a reversing mill where the downstream coiler furnaces are in vertical alignment with one above the pass line and the other below the pass line. The method of rolling includes reducing a transfer bar in the reversing mill and coiling it in one of the downstream coiler furnaces. The coil is then passed back through the reversing mill into the upstream coiler furnace. Thereafter, the coil passes through the reversing mill for the third time and is again coiled in one of the downstream coiler furnaces. The coil is then uncoiled and directed into the finishing train while a subsequent coil is processed in the reversing mill utilizing the empty downstream coiler furnace. The rolling of the workpiece through the intermediate mill is done independent of the finishing train.

9 Claims, 4 Drawing Figures

VERTICAL COILER FURNACE AND METHOD OF ROLLING

BACKGROUND OF THE INVENTION

This invention relates to the hot rolling of metal slabs to strip thicknesses in coil form having specific weights on the order of 500 PIW or greater. More particularly, it relates to the use of an intermediate mill to equalize cycle times at the various stations throughout the hot strip mill.

DESCRIPTION OF THE PRIOR ART

The modern wide hot strip mill has become quite standardized in its general layout. Slabs are heated in two or more relating furnaces. Driven table rolls convey the steel from the furnace to a roughing train which generally consists of a roughing scale breaker and/or vertical edgers and a plurality of two high or four high roughing stands. Generally, the roughing stands are spaced apart by a distance greater than the slab length through the preceding mill, although some roughing trains now include the final rolling stands operating in tandem. Reversing roughing mills are also used in modern hot strip mills.

Separating the roughing train from the finishing train is a holding table. The holding table feeds into a plurality of four high finishing stands which operate in tandem. Preceding the first finishing stand there is usually a flying shear for cutting the front end and the tail end of the transfer bar. Following the finishing train there is a long table called the runout table consisting of individually driven rolls which feed into downcoilers at the table end. The runout table, which is quite long, is provided with water sprays above and below the rollers for rapid cooling of the rolled strip to the desired temperature for coiling.

In the existing arrangements, the finishing train is always the production bottleneck for a continuous rougher and in most cases for a reversing rougher and while the individual roughing mills can operate at very high tons/hour the finishing mill controls the cycle time of the entire hot strip mill since it must operate in synchronization to handle the strip which is at its thinnest cross section and traveling at its greatest speed.

It has recently been suggested to substitute a hot reversing mill having coiler furnaces or either side thereof for the first stand of a finishing mill. In such an operation the first two passes through the hot reversing mill can be carried out independent of the speed cone of the finishing train and it is only the third pass through the reversing mill that must be synchronized with the finishing train. While such a system has certain advantages, the cycle time of the third pass through the reversing mill is the same as the cycle time of the finishing train because they are operated in synchronization. Therefore, the total time through the reversing mill is the cycle time of the finishing train plus the time for the first two passes through the reversing mill.

A number of multiple coiler furnaces used in conjunction with reversing mills are disclosed in U.S. Pat. No. 2,658,741 and British Pat. No. 652,772. In each of those patents there is disclosed an arrangement which includes one downstream coiler furnace above the pass line and a second coiler furnace horizontally spaced from the first and below the pass line. However, in each case the coiler furnaces are not part of a true, intermediate mill and there exists interference between the downstream coiler furnaces if operated totally independent of the finishing train.

SUMMARY OF THE INVENTION

It is an object of our invention to remove some of the existing production load requirements off of the finishing mill so that it can operate at a higher cycle time and thus not be the bottleneck as in standard mills. It is a further objective to utilize an intermediate mill which has a cycle time closely compatible with that of the roughing train and the finishing train. In addition to reducing the bottleneck of the finishing train, it is our desire to maintain a relatively constant temperature from head to tail of a workpiece being rolled so as to improve metallurgical properties and simplify the rolling requirements of the individual mills. Since we are providing three passes through the same reversing mill, it is also possible to same distance and, therefore, substantially reduce the overall length of the hot strip mill. It is further an object to provide a heat efficient arrangement whereby one of the coiler furnaces gains heat from the other. Further, it is an object to arrange the intermediate mill to have a minimum amount of mechanical equipment to accomplish the rolling cycles and to eliminate any interference which has existed heretofore with various furnace coiler arrangements. Finally, our invention balances an open reversing cycle, an enclosed reversing cycle and a continuous open cycle through optimum conditions of heat loss and reduction in thickness.

Our invention is an intermediate mill in which there is a single upstream coiler furnace and a pair of downstream coiler furnaces on opposing sides of the hot reversing mill. The downstream coiler furnaces are in vertical alignment. The method of rolling includes making a first pass through the reversing mill and coiling in one of the downstream coiling furnaces, thereafter decoiling back through the reversing mill into the upstream coiler furnace and finally making a third pass through the reversing mill into an empty downstream coiler. The intermediate mill can be operating while a coil is being fed from the other downstream coiler into the finishing train.

DESCRIPTION OF THE PREFERRED EMBODIMENTS

Figure 1:
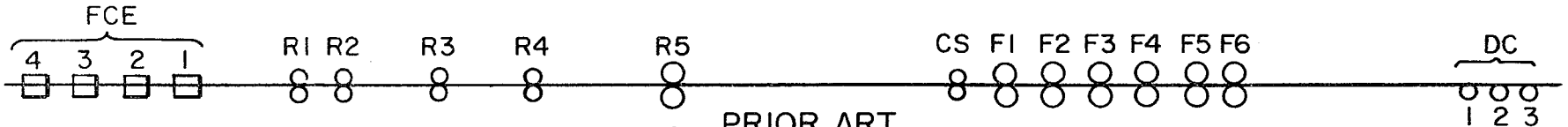
PRIOR ART Fig. 1
FIG. 1 is a schematic of an existing prior art hot strip mill.

FIG. 1 is a schematic of an existing continuous hot strip mill primarily used in the production of low carbon steel coils. Four reheat furnaces feed slabs one at a time onto a roller conveyor and to the roughing train made up of roughing stands R1 through R5. Various scale breakers and/or vertical edgers (not shown) are employed with the roughing train. The roughing train will accept slabs on the order of ten inches thick and reduce them to approximately one inch out of R5. The furnaces have an existing capacity of 720 tons/hour and the various roll stands R1 through R5 have production capabilities of 40 inch wide low carbon steel slabs ranging from 1683 tons/hour for R5 to 4510 tons/hour for R2.

A holding table separates R5 from the finishing train made up of six finishing mills F1 through F6, FIG. 1. Upstream of the finishing train is a crop shear CS. The finishing train operates in complete synchronization and reduces the transfer bar to the required final thickness. The finishing train has a production capacity for 40 inch wide and 0.080 inch thick strip of 576 tons/hour. Downstream of F6 is a long runout table with appropriate cooling (not shown). The strip is finally coiled on a plurality of downcoilers 1–3 located at the end of the runout table.

Figure 2:
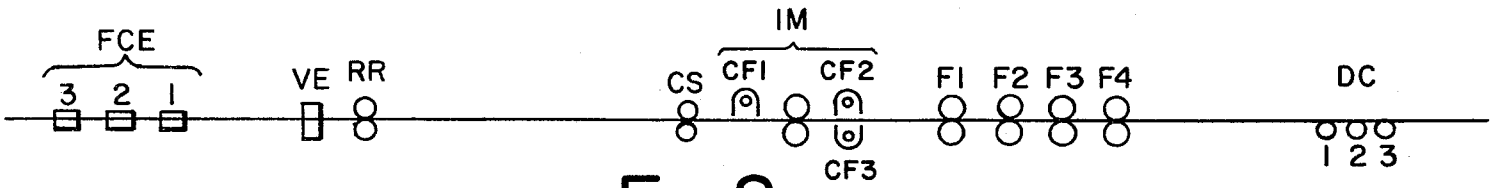
FIG. 2 is a schematic of a hot strip mill employing our intermediate mill and method of rolling.

Our arrangement for utilizing an intermediate mill, IM, is illustrated in FIG. 2. The intermediate mill takes some of the production load from the finishing train and the roughing train thereby equalizing cycle times and eliminating the finishing mill as the production bottleneck. Three slab furnaces 1–3 are provided and the roughing train comprises a single hot reversing rougher RR preceded by a vertical edger. The intermediate mill IM is positioned between the reversing rougher RR or a roughing train and the finishing train F1 through F4. The intermediate mill, IM, consists of a crop shear and a hot reversing mill having a coiler furnace CF1 on the upstream side and two vertically aligned coiler furnaces CF2 and CF3 on the downstream side with the downstream coiler furnaces CF2 and CF3 positioned on opposite sides of the pass line respectively. Downstream of the finishing train F1 through F4 are the standard runout table and downcoilers 1–3.

Figure 3:
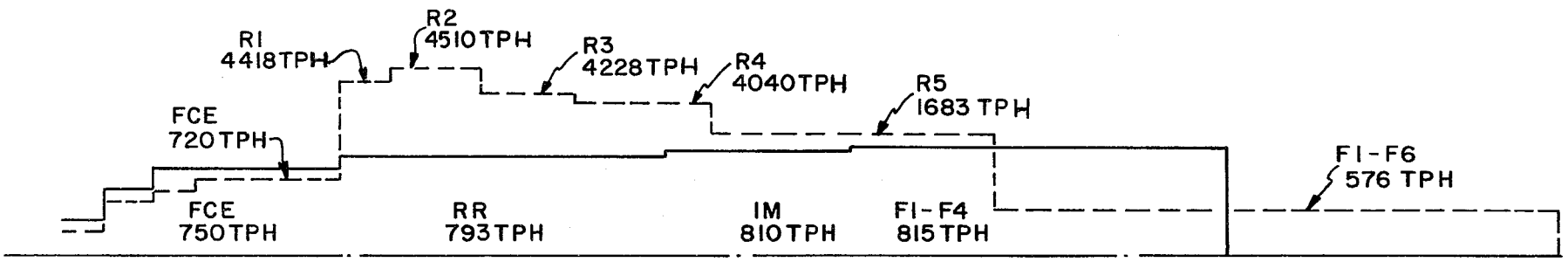
FIG. 3 is a block diagram showing comparative cycle times and production capabilities of our mill as compared to the prior art hot strip mill.

The productivity of the hot strip mill employing our intermediate mill based on a 40 inch wide and 0.080 inch thick strip is 750 tons/hour for the furnaces, 793 tons/hour for the reversing roughing mill RR, 810 tons/hour for the intermediate mill IM and 815 tons/hour for the finishing train F1 through F4. The comparison of the production rates on comparable product for the prior art mill of FIG. 1 and our mill of FIG. 2 is shown in FIG. 3. Not only has the capacity of the finishing mill been increased 239 tons/hour over the prior art mill, but each of the operations through the hot strip mill has been equalized in terms of productivity, thereby avoiding bottlenecks and permitting a greater latitude in production planning.

Figure 4:
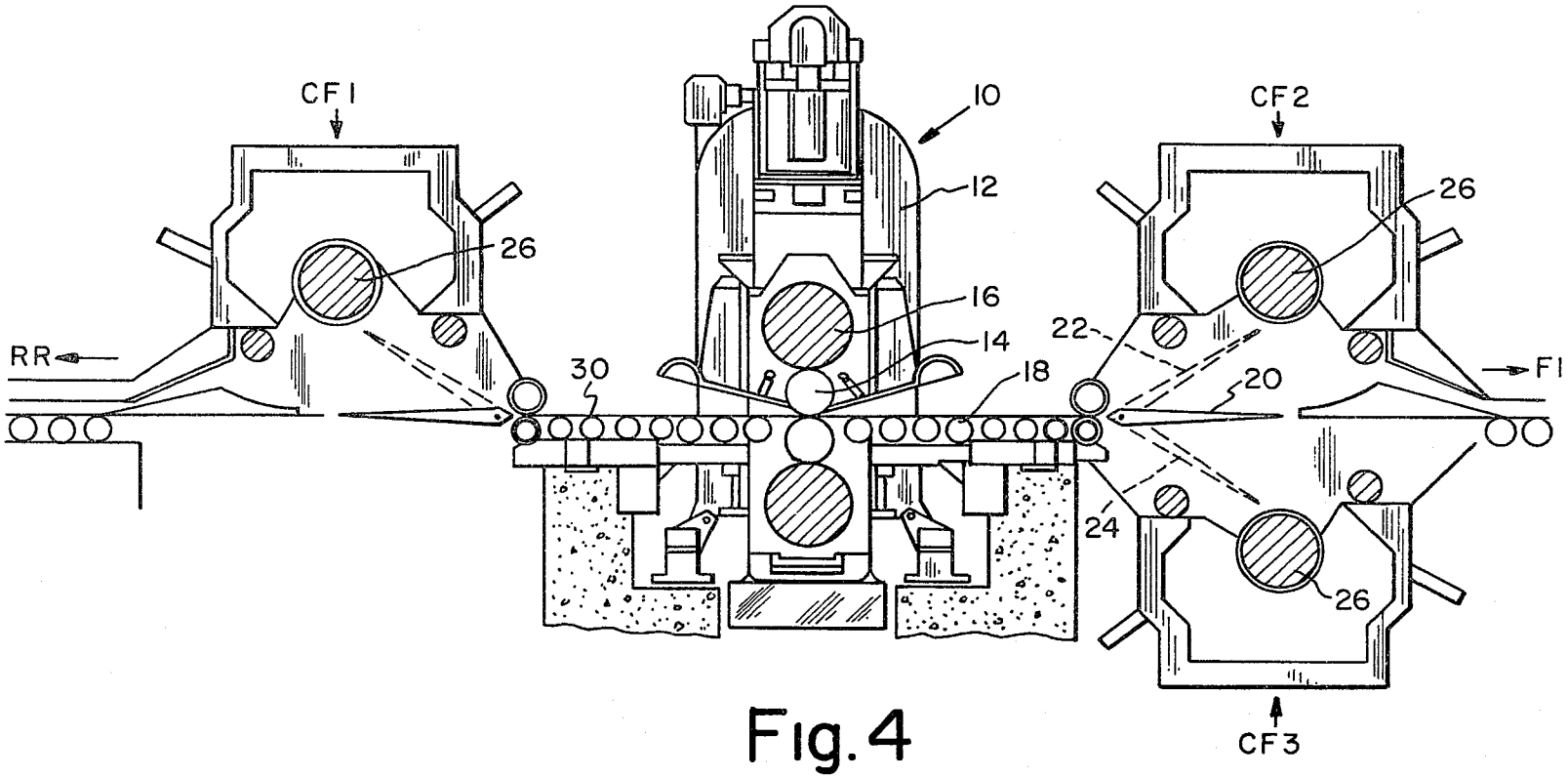
FIG. 4 is a schematic elevation showing our intermediate mill.

The intermediate mill is shown in more detail in FIG. 4. The intermediate mill includes a hot reversing mill 10 having a mill housing 12 and a pair of work rolls 14 in concert with backing rolls 16. A series of disc rolls 18 convey the strip on either side of the mill and along the pass line 30.

The upstream coiler furnace CF1 is of the conventional type and includes a slotted drum 26 to receive the strip from the mill and to initiate the formation of the coil within the furnace about the drum. The downstream coiler furnaces CF2 and CF3 are in vertical alignment with each other and on opposite sides of the pass line 30. Each downstream coiler furnace also includes a slotted drum 26 for receiving the strip and initiating the formation of the coil. The downstream coiler furnaces CF2 and CF3 have the capability of receiving the strip downstream of the reversing mill and thereafter directing the coil downstream into the first finishing stand F1 of the finishing train. A number of means are known for reversing the direction of the strip in the coiler furnace and those means do not form part of the subject invention.

A common deflector gate 20 lies in ambush within the roll discs 18 and can be directed upward into the position shown at 22 or downward into the position shown at 24 so as to direct strip into either of the coiler furnaces, FIG. 4. In addition to utilizing a common deflector, the upper coil furnace CF2 receives heat from the lower coil furnace CF3, thereby conserving energy and assisting in the heating function of the overall system. Since the coiler furnaces are in exact vertical alignment, one coiler furnace can be receiving material from the reversing mill while the other coiler furnace is directing material into the finishing train. With the vertical arrangement there is no interference from either of the coiler furnaces with the other.

The operation of our intermediate mill in conjunction with the hot strip mill is as follows. A first metal slab is passed through the roughing mill and reduced to a first transfer bar. The first transfer bar immediately goes through the work rolls of the reversing mill stand where it is reduced further in thickness to a workpiece. The workpiece is coiled in one of the downstream coiler furnaces and thereafter it is uncoiled in the same direction from which it came back through the reversing mill where it is further reduced. It is there coiled in the upstream coiler furnace. The workpiece is then passed back through the reversing mill in a third pass where it is further reduced and coiled in either of the downstream coiler furnaces depending on which one is available. The next slab can be processed in the same manner and as it is going through the reversing mill, it is fed into the open downstream coiler furnace. Simultaneous therewith the downstream coiler furnace having a coil therein can be feeding directly into the finishing train and, more particularly, into F1. It can therefore be seen that the three passes through the reversing mill are totally independent of the speed cone of the finishing mill. Therefore, the speed through the reversing mill may be increased beyond the speed of the strip through the finishing train.

Another important consideration in any hot strip mill is the ability to maintain the minimum temperature differential between the head and tail of the strip during processing. The use of the intermediate mill is an effective way to accomplish that minimum differential. The following data in Table 1 was determined for a 1000 PIW strip rolled from a 40 ton slab having dimensions of 11.3 inches by 72 inches by 26 feet.

TABLE 1

Head and Tail Temperature*
40 ton slab - 11.3 inches × 72 inches × 26 feet

| | Exit | Temperature °F. | | | |
|---|---|---|---|---|---|
| | Gauge | Entry | | Exit | |
| Mill | Inches | Tail | Head | Tail | Head |
| IM | 0.40 | 1826 | 1781 | 1822 | 1778 |
| F1 | 0.23 | 1764 | 1724 | 1706 | 1668 |
| F2 | 0.14 | 1683 | 1646 | 1680 | 1644 |
| F3 | 0.094 | 1657 | 1622 | 1652 | 1618 |
| F4 | 0.080 | 1629 | 1597 | 1620 | 1589 |

*Tail-Head refers to the position out of furnace.

It can be seen that temperature differential between tail and head entering and exiting the intermediate mill is on the order of 45°. The same differential through the finishing train is on the order of 30°. This 30° differential is based on the raw data and does not take into account the zoom process routinely employed to speed up the last portion of the strip to further minimize this temperature differential. A simple ten percent zoom virtually eliminates the temperature differential found in the raw data.

The peak productivity of our mill for the above 1000 PIW mill steel coil is given in Table 2.

TABLE 2

| Peak Production 1000 PIW - Mild Steel | |
|---|---|
| Roughing Mill (RR) | 963.422 TPH |
| Intermediate Mill (IM) | 917.999 TPH |
| Finishing Train (F1-F4) | 880.243 TPH |

Again the benefits of transferring part of the finishing train production load to the intermediate mill can be seen.

For a typical ten to eleven inch slab the reduction to 1.75 inches is carried out on the reversing rougher, the reduction from 1.75 inches to about 0.4 inch is carried out on the intermediate mill utilizing coiler furnaces and the final reduction from 0.4 to strip thicknesses on the order of 0.080 is carried out on the continuous finishing train. This compares favorably with the standard hot strip mill where the transfer bar enters the finishing train at about one inch and therefore the finishing train is taking much more reduction to produce the same final gauge. It limits the speed and production of the finishing train. In the subject hot strip mill employing our intermediate mill, the power saved due to the lesser reduction has been utilized to increase the speed and thus the production of the finishing train.

We claim:

1. In a processing line for rolling metal along a substantially horizontal pass line and including a rolling mill for reducing the metal, the improvement comprising a pair of coiler furnaces downstream of the rolling mill, said coiler furnaces being in vertical alignment with one being above the pass line and the other being below the pass line, each coiler furnace capable of receiving a workpiece from the rolling mill, forming a coil from the workpiece and thereafter directing the coil out of the coiler furnace in a direction downstream thereof along the pass line.

2. The improvement of claim 1 including means to deflect the workpiece to one or the other of said coiler furnaces.

3. The improvement of claim 2, said deflecting means comprising a deflector gate extending along the pass line and directable toward either of said coiler furnaces.

4. In a hot strip mill for rolling steel slabs and the like along a pass line including a roughing train or mill and a finishing train, the improvement comprising an intermediate mill positioned between the roughing train or mill and the finishing train, said intermediate mill including a reversing mill, at least one coiler furnace positioned upstream of the reversing mill and two coiler furnaces positioned downstream of the coiler furnace, said two coiler furnaces being in vertical alignment with one furnace above the pass line and the other furnace below the pass line whereby either downstream coiler furnace may receive a workpiece and direct it to the finishing mill while the other of said downstream coiler furnace may be processing another workpiece, said intermittent mill operable independent of the finishing train.

5. The improvement of claim 4 including means to deflect the workpiece to one or the other of said coiler furnaces.

6. The improvement of claim 5, said deflecting means comprising a deflector gate extending along the pass line and directable toward either of said coiler furnaces.

7. In the hot rolling of metal slabs to strip thickness having PIW's on the order of 500 to 1000 along a pass line on a hot strip mill having a roughing train or mill for forming transfer bars and a finishing train, the improvement comprising:

A. providing an intermediate mill between the roughing train or mill and the finishing train, said intermediate mill including a reversing mill, a coiler furnace upstream of the reversing mill and two coiler furnaces downstream of said reversing mill, said two coiler furnaces being in vertical alignment with one furnace above the pass line and the other furnace below the pass line;

B. reducing a first transfer bar into coil form through at least three passes on the reversing mill independent of the finishing train while coiling once in the upstream coiler furnace and twice in the downstream coiler furnace so as to end up in one of said downstream coiler furnaces; and C. reducing a second transfer bar into coil form in the intermediate mill so as to end up in the other of said downstream coilers while simultaneously feeding the finishing train from said first downstream coiler.

8. In the hot rolling of metal slabs to strip thickness along a pass line, the steps comprising:

A. passing a first heated metal slab into and through a roughing mill and reducing the slab to a transfer bar;

B. passing said transfer bar immediately to and between the work rolls of a reversing intermediate mill stand and reducing it in thickness to a workpiece;

C. passing the workpiece immediately into one of two coiler furnaces located on the downstream side of said reversing intermediate mill stand and coiling it, said coiler furnaces being in vertical alignment and on opposite sides of the pass line;

D. uncoiling said workpiece from said downstream coiler furnace and passing it back through and further reducing the workpiece in said reversing intermediate mill stand;

E. immediately passing the first workpiece into and coiling it in a coiler furnace on the upstream side of said mill stand;

F. thereafter uncoiling and discharging the workpiece from said upstream coiler furnace and passing it between the work rolls of said reversing intermediate mill stand and further reducing it therein, the rolling speed on said pass being independent of the speed on subsequent passes through continuous finishing stands;

G. immediately passing the workpiece into and coiling it in an empty downstream coiler furnace;

H. passing said workpiece from the downstream coiler successfully through and reducing it further in a plurality of continuous finishing stands while simultaneously passing a second heated slab through any or all of the steps A–G; and I. thereafter cooling the strip and coiling it on a finish coiler.

9. The method of claim 8 including reducing a slab on the order of 10 inches to a transfer bar on the order of 1.75 inches on a roughing reversing mill, reducing the transfer bar to a strip on the order of 0.4 inch on the reversing intermediate mill stand and thereafter reducing to a final strip thickness on the continuous finishing stands.

* * * * *